United States Patent [19]

Evans

[11] 4,128,171

[45] Dec. 5, 1978

[54] PACKAGED LIGHT FIXTURE

[75] Inventor: Mark Evans, Thousand Oaks, Calif.

[73] Assignee: Kidde Consumer Durables Corp., Bala Cynwyd, Pa.

[21] Appl. No.: 845,993

[22] Filed: Oct. 27, 1977

[51] Int. Cl.[2] ..... B65D 85/30; B65D 81/06

[52] U.S. Cl. ..... 206/320; 206/587; 220/410; 220/448

[58] Field of Search ..... 206/320, 326, 587, 588, 206/592, 593, 591, 594, 577; 229/14 C; 220/410, 448, 445

[56] References Cited

U.S. PATENT DOCUMENTS

| | | | |
|---|---|---|---|
| 2,570,946 | 10/1951 | Hennessey | 229/14 C |
| 3,142,446 | 7/1964 | Okamoto | 206/326 |
| 3,146,932 | 9/1964 | Mayer | 229/14 C |
| 3,158,261 | 11/1964 | Stiffel | 206/326 |
| 3,294,226 | 12/1966 | McFarland et al. | 229/14 C |
| 3,338,501 | 8/1967 | Clay | 229/14 C |
| 3,837,479 | 9/1974 | Lehmann | 229/14 C |

*Primary Examiner*—William T. Dixson, Jr.
*Attorney, Agent, or Firm*—Seidel, Gonda & Goldhammer

[57] ABSTRACT

A container having a closable lid has packaged therein a lamp base, lamp shade, and shade support in a manner which minimizes the height of the container and minimizes shifting of the contents by way of novel channel-shaped liner means.

10 Claims, 5 Drawing Figures

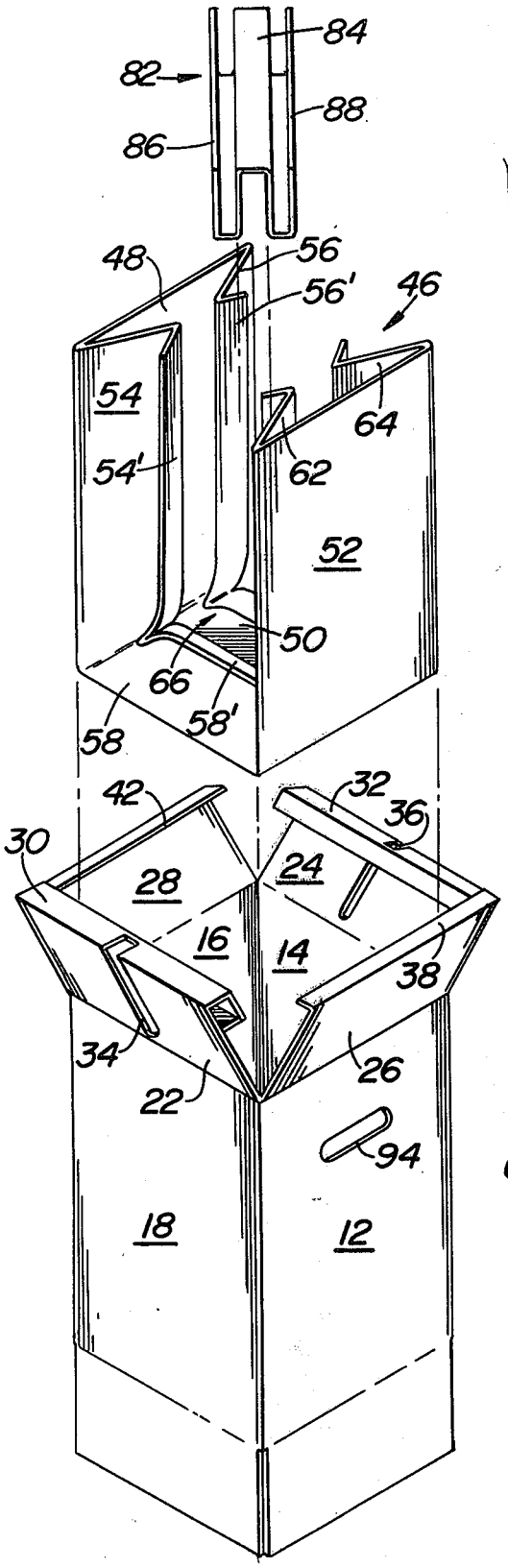
FIG. 3
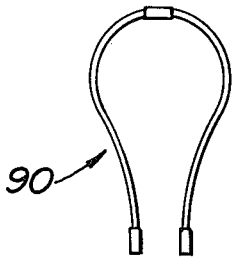
FIG. 5
FIG. 4
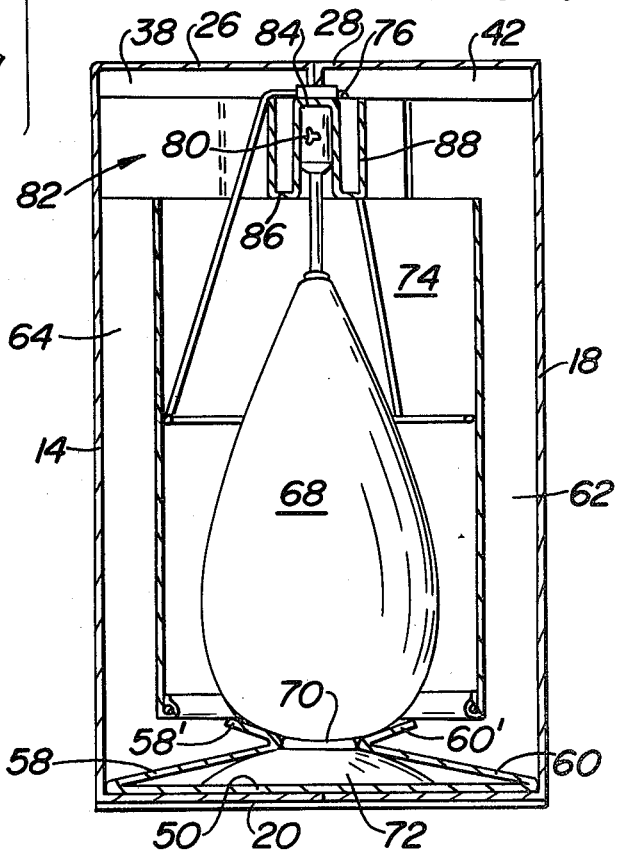

PACKAGED LIGHT FIXTURE

BACKGROUND

The present invention is directed to a solution of the problem of how to package a lamp and lamp shade so as to minimize the dimensions of the container while protecting the lamp base and lamp shade from damage during shipment. Damage of the lamp base, when made from glass or ceramic material, is a common problem. A typical lamp and shade have a combined height of 36 to 40 inches when using a shade 14 inches in diameter.

SUMMARY OF THE INVENTION

The packaged light fixture of the present invention includes a container having a closable lid. A U-shaped liner which is channel-shaped in section is provided within the container so as to extend along opposite walls and across the bottom wall of the container. A lamp base is positioned in the container and has a lower end disposed within the liner so that the liner impedes movement of the base in a first transverse direction.

A lamp shade for the lamp base is provided in the container and in surrounding relation to the lamp base. A shade support for supporting the shade on the lamp base is separable from the shade and is disposed within the container. The shade is maintained spaced from contact from the walls of the container by the liner. A removable brace overlies the shade and embraces the upper end of the lamp base to impede movement of the base in a second transverse direction which is generally perpendicular to said first transverse direction.

It is an object of the present invention to provide packaged light fixture wherein the overall height of the container is only slightly higher than the lamp base while protected the lamp base from movement during shipping.

It is another object of the present invention to provide a novel packaged light fixture which is simple, economical, and reliable whereby special forms, jigs or the like are unnecessary.

Other objects of the invention will appear hereinafter.

For the purpose of illustrating the invention, there is shown in the drawings a form which is presently preferred; it being understood, however, that this invention is not limited to the precise arrangements and instrumentalities shown.

FIG. 3 is an exploded perspective view excluding the components of the light fixture.

FIG. 4 is a sectional view taken along the line 4—4 in FIG. 2.

FIG. 5 is a plan view of an adaptor for interconnecting the lamp shade support and the upper end of the lamp base.

Referring to the drawings in detail, wherein like numerals indicate like elements, there is shown in FIG. 1 a packaged light fixture in accordance with the present invention designated generally as 10.

Figure 1:
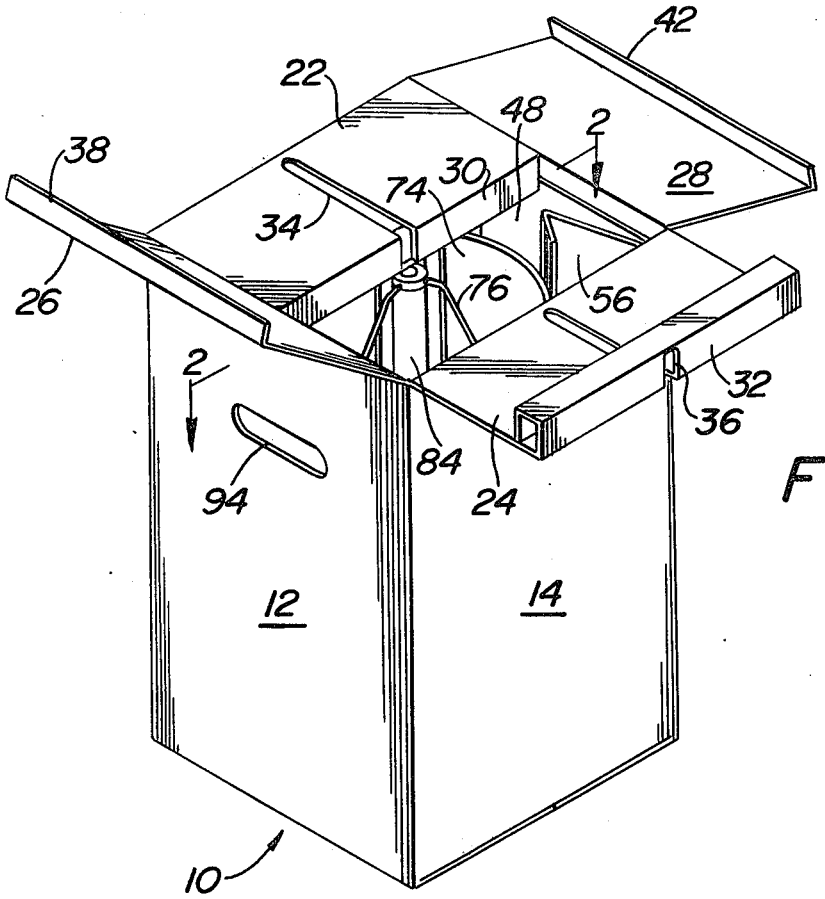
FIG. 1 is a perspective view of the packaged light fixture in accordance with the present invention with a portion of the lid in an open disposition.

The container is made from corrugated paperbroad and includes side walls 12, 14, 16 and 18 and a double thickness bottom wall 20. The container has a closeable lid preferably in the form of top wall panels 22, 24, 26 and 28.

The container has an overall height of appoximately 29 inches and the transverse dimensions of the sides are each 17 inches. A container of these dimensions will facilitate packaging a lamp 36 to 40 inches high for the combined height of the lamp base and shade. The lamp base has a height of approximately 22–26 inches, the shade has a height of 17 inches, and the shade has a diameter of 14 inches.

Referring to FIG. 1, the top wall panel 22 terminates in a flange 30 which is generally perpendicular thereto and the panel contains an elongated slot 34. The top wall panel 24 terminates in a flange 32 which is generally perpendicular thereto and the panel contains an elongated slot 36. The slots 34 and 36 lie along a common line and are located in the central portion of their respective panels.

The top wall panel 26 is provided with a flange 38 which is generally perpendicular to the panel. The top wall panel 28 is similarly provided with flange 42. Each of the flanges 38, 42 has a length so that it may extend into the slots 34, 36. Each of the slots 34, 36 has a width sufficient to receive both of the flanges 38, 42.

A liner 46 is disposed in the container. As shown more clearly in FIG. 3, the liner 46 is generally U-shaped so as to lie along two opposite walls of the container and along the bottom wall. The liner 46 is channel-shaped in section and includes wall segments 48, 50 and 52 which are defined by discrete parallel fold lines. Wall segment 48 is shorter than the height of wall 16 and extends therealong. The length of segment 50 corresponds to the length of bottom wall 20. Wall segment 52 is shorter than the height of wall 12 and extends therealong.

The wall segment 48 along its side edges is provided with inwardly converging angled sections 54 and 56 which terminate in diverging tabs 54', 56', respectively. The wall segment 50, as shown more clearly in FIG. 4, is provided with inwardly converging angled sections 58, 60 which terminate in diverging tabs 58', 60', respectively. The wall segment 52 is provided with inwardly converging angled sections 62, 64 which terminate in diverging tabs 62', 64', respectively.

On each of the wall segments 48–52, the intersection of the angled sections and the respective tabs are spaced from one another so as to define a channel 66 down the length of segment 48, along the segment 50, and up the segment 52. A lamp base 68 has a neck portion 70 disposed within the channel 66 with a support portion 72 overlying wall segment 50. The angled sections 58, 60 overlie the support portion 72 and the associated tabs 58' and 60' respectively engage the juxtaposed portion of the lamp base 68. See FIG. 4. Thus, the portion of the liner 46 which overlies the bottom wall 28 of the container is utilized to prevent the lamp base 68 from moving transversely within the container in one direction, namely from left to right or vice versa in FIG. 4.

The lamp shade 74 is disposed within the container surrounding the lamp base 68 and lies on the tabs 58', 60'. A shade support 76 is telescoped over a portion of the lamp base 68 and is supported from above in a manner set forth hereinafter so that it can prevent the shade from being crushed inwardly.

The lamp base 68 at its upper end terminates in socket 80 having ears for receiving the legs of an adaptor 90. The adaptor 90 is shown in FIG. 5 and is disposed within the container. For purposes of clarity of illustration, the adaptor 90 is not shown in the container.

Figure 2:
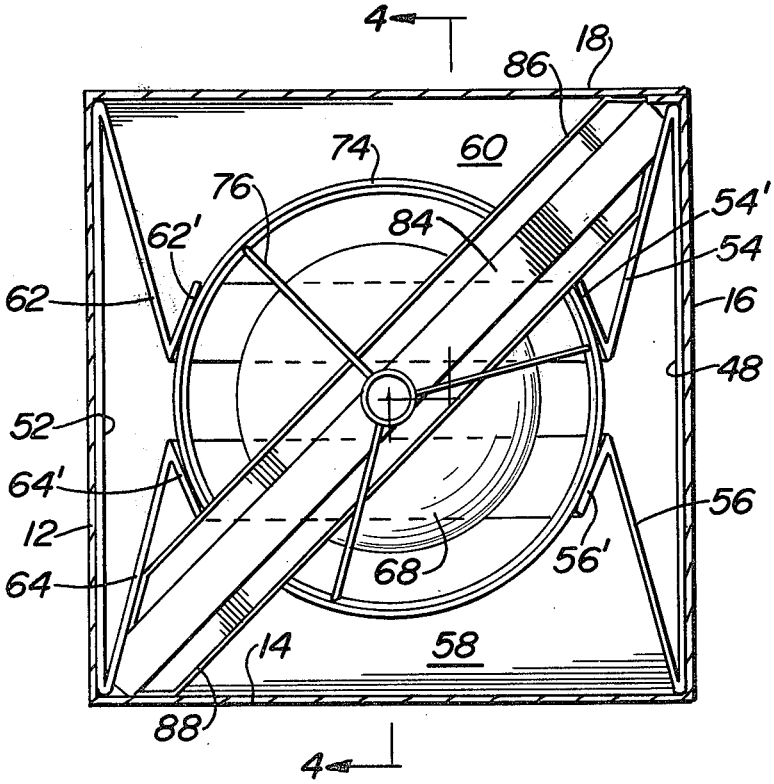
FIG. 2 is a sectional view taken along the line 2—2 in FIG. 1.

A brace 82 is provided for preventing the lamp base from moving in a direction toward and away from walls 14 and 18 and for suspending support 76 as shown in FIGS. 1 and 4. The brace 82 is U-shaped or W-shaped in cross-section with the opening on the lower side thereof remote from the bight portion 84 and terminates in upwardly disposed flanges 86, 88. As shown more clearly in FIG. 2, the brace 82 is diagonally disposed so as to extend between opposite corners of the container overlying socket 80, the lamp shade 74, and in contact with the free edge of tabs 56' and 62'.

The flanges 86, 88 on the brace 82 overlie the upper edge of the lamp shade 74 and maintain the lower edge of the lamp shade 74 into contact with the tabs 58', 60'. The flanges 30, 32, 38, 42 on the top wall panels contact the bight portion 84 of the brace 82 and support 76 and maintain downward pressure on the same thereby impeding vertical movement of base 68, support 76, and shade 74. It will be noted that the distance between the downwardly extending legs on the brace 82 correspond generally to the diameter of the socket 80 on the lamp base 68.

In view of the above, it should now be apparent that I have minimized the height so that the container is only slightly higher than the lamp base while at the same time the packaging concept involves a shade which is removable from the lamp base for purposes of shipment and that the shade has a removable support for purposes of shipment. Further, it will be apparent that the lamp base 68, which may be made of frangible material such as glass and ceramic, will be protected during shipment from movement in mutually perpendicular directions by the combined effect of the liner 46 and brace 82. Also, the combined effect of liner 46 and brace 82 maintains the lamp shade 74 against the tabs 58', 60' while the tabs 54', 56', 62' and 64' engage the outer periphery of the lamp shade 74 as shown more clearly in FIG. 2. As shown in FIG. 4, the bottom ring on support 76 is disposed within shade 74.

Since the lamp base and lamp shade are packaged in the same container, inventory at retail establishments is simpler. There is no longer a need for inventory of a base and a separate inventory of the lamp shade. Clerks do not have to handle or wrap the base and shade separately. Warehouse storage space is minimized. A knockout hole 94 may be provided in a wall such as the upper end of walls 12 and/or 16 to provide a carrying handle.

The present invention may be embodied in other specific forms without departing from the spirit or essential attributes thereof and, accordingly, reference should be made to the appended claims, rather than to the foregoing specification as indicating the scope of the invention.

I claim:

1. A packaged light fixture comprising:

(a) a container having a closable lid, (b) a U-shaped liner which is channel-shaped in section, said liner being disposed within the container, a portion of said liner overlying a bottom of the container and a portion of oppositely disposed walls of the container, (c) a lamp, a shade for said lamp, said shade surrounding said lamp and being spaced from the upright walls of the container by said liner, (d) a shade support for supporting said shade from said lamp base, said shade support being separate from the shade and being disposed within said container, (e) a removable brace overlying said shade and embracing the upper end of said lamp base to impede movement of said lamp base in a second transverse direction which is generally perpendicular to said first direction.

2. A packaged light fixture in accordance with claim 1 wherein said shade support is frustoconical and extends around a portion of said lamp base within said lamp shade.

3. A packaged light fixture in accordance with claim 1 wherein said brace extends diagonally across the upper end of said container.

4. A packaged light fixture in accordance with claim 3 wherein said closable lid includes top wall panels, at least one of said top wall panels having a flange contacting an upper surface on said brace.

5. A packaged light fixture in accordance with claim 1 wherein said liner has a channel, said lamp base having a neck portion disposed within said channel, said liner having upwardly diverging tabs adjacent said channel, the lower end of said lamp shade resting on said tabs, and said liner having vertically disposed tabs engaging the outer periphery of said lamp shade.

6. A packaged light fixture comprising:

(a) a paperboard container having a closable lid, (b) a U-shaped liner which is channel-shaped in section, said liner being disposed within said container and overlying at least a portion of the bottom wall of the container as well as at least a portion of oppositely disposed vertical walls of the container, said channel-shape of said liner being defined by a wall segment having angled sections converging toward one another and terminating in diverging tabs spaced from another so as to define a central channel, (c) a lamp base in said container, said lamp base having a support portion disposed within said liner and a neck portion in said channel so as to impede sideways movement of the lamp base, (d) a lamp shade for said lamp, said shade surrounding said lamp and being in contact with said tabs on said liner, (e) a discrete shade support for said lamp shade, said support being disposed at least in part within said lamp shade.

7. A packaged light fixture in accordance with claim 6 wherein said shade support is frustoconical and extends around at least a part of said lamp base.

8. A packaged light fixture in accordance with claim 6 including a removable brace overlying said shade and embracing the upper end of said lamp base to impede movement of said lamp in a direction parallel to said channel.

9. A package for shipping a light fixture and shade comprising:

(a) a rectangular paperboard container having a closeable lid, (b) a U-shaped liner which is channel-shaped in section, said liner being disposed within said container and overlying the bottom wall of the container as well as at least a portion of oppositely disposed vertical walls of the container, said channel-shape of said liner being defined by a wall segment having angled sections converging toward one another and terminating in diverging tabs spaced from one another so as to define a central channel along the length of said liner, the width of each tab being substantially narrower than the width of its associated angled section, (c) a removeable brace of paperboard in said container and having an opening on a lower surface thereof, said brace having a length sufficient so that it extends diagonally between two corners of said container.

10. A package in accordance with claim 9 wherein said closable lid includes top wall panels, at least one of said top wall panels having a flange generally perpendicular thereto and extending downwardly for contacting an upper surface on said brace.

* * * * *